US005800955A

United States Patent [19]

Kashimura et al.

[11] Patent Number: 5,800,955

[45] Date of Patent: *Sep. 1, 1998

[54] ELECTROPHOTOGRAPHIC PHOTOSENSITIVE MEMBER HAVING POLYCARBONATE-CONTAINING SURFACE LAYER

[75] Inventors: Noboru Kashimura, Tokyo; Harumi Sakoh; Shoji Amamiya, both of Kawasaki; Tatsuya Ikezue, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 677,790

[22] Filed: Jul. 10, 1996

Related U.S. Application Data

[63] Continuation of Ser. No. 124,210, Sep. 21, 1993, abandoned.

[30] Foreign Application Priority Data

| | | | |
|---|---|---|---|
| Sep. 21, 1992 | [JP] | Japan | 4-274879 |
| Sep. 21, 1992 | [JP] | Japan | 4-274880 |
| May 19, 1993 | [JP] | Japan | 5-139284 |

[51] Int. Cl.[6] ..... G03G 5/05; G03G 5/147

[52] U.S. Cl. ..... 430/58; 430/66; 430/96

[58] Field of Search ..... 430/96, 66, 58

[56] References Cited

U.S. PATENT DOCUMENTS

| | | | |
|---|---|---|---|
| 4,772,526 | 9/1988 | Kan et al. | 430/58 |
| 4,863,823 | 9/1989 | Hiro et al. | 430/66 |
| 4,877,701 | 10/1989 | Hiro et al. | 430/59 |
| 4,920,022 | 4/1990 | Sakakibara et al. | 430/59 |
| 5,080,989 | 1/1992 | Gruenbaum et al. | 430/96 |
| 5,246,807 | 9/1993 | Kanemaru et al. | 430/58 |
| 5,368,931 | 11/1994 | Kato et al. | 430/49 |
| 5,521,041 | 5/1996 | Miyamoto et al. | 430/96 |
| 5,585,214 | 12/1996 | Kashimura et al. | 430/96 |

FOREIGN PATENT DOCUMENTS

| | | | |
|---|---|---|---|
| 0409737 | 1/1991 | European Pat. Off. . | |
| 63-065444 | 3/1988 | Japan | 430/96 |
| 1-169456 | 7/1989 | Japan | 430/96 |
| 1153506 | 5/1969 | United Kingdom . | |
| WO93-18081 | 9/1993 | WIPO . | |

OTHER PUBLICATIONS

Chemical Abstracts Registry File: 150373-06-1, 1996.

Grant, Roger & Claire Grant. Grant & Hackh's Chemical Dictionary, fifth edition. New York: McGraw Hill Inc., p. 431, 1987.

Patent Abstrs. of Japan, vol. 12, No. 288 (P-741) Aug. 1988 re JP 63-065451.

Patent Abstrs. of Japan, vol. 14, No. 472 (P-1116) Oct. 1990 re JP 2-189551.

Patent Abstrs. of Japan, vol. 17, No. 611 (P-1641) Oct. 1993 re JP 5-188628.

*Primary Examiner*—Christopher D. Rodee

*Attorney, Agent, or Firm*—Fitzpatrick, Cella, Harper & Scinto

[57] ABSTRACT

An electrophotographic photosensitive member is disclosed which comprises a conductive support and a photosensitive layer provided on the conductive support. A surface layer of the electrophotographic photosensitive member contains a polycarbonate resin having a chain fluoroalkyl group having 4 or more carbon atoms. Also, an electrophotographic apparatus and a device unit are disclosed which comprise the electrophotographic photosensitive member.

7 Claims, 1 Drawing Sheet

ELECTROPHOTOGRAPHIC PHOTOSENSITIVE MEMBER HAVING POLYCARBONATE-CONTAINING SURFACE LAYER

This application is a continuation of application Ser. No. 08/124,210 filed Sep. 21, 1993, now abandoned.

BACKGROUND OF THE INVENTION

1. Field of the invention

This invention relates to an electrophotographic photosensitive member, and more particularly to an electrophotographic photosensitive member having a surface layer containing a resin with a specific structure. This invention also relates to an electrophotographic apparatus and an apparatus unit which have such an electrophotographic photosensitive member.

2. Related Background Art

Inorganic materials such as selenium, cadmium sulfide and zinc oxide are hitherto known as photoconductive materials used in electrophotographic photosensitive members. Organic materials including polyvinyl carbazole, phthalocyanine and azo pigments have attracted notice on the advantages that they promise a high productivity and freedom from environmental pollution, and have been put into wide use although they tend to be inferior to the inorganic materials in respect of photoconductive performance or running performance. In recent years, new materials having overcome such disadvantages have been studied, and are surpassing the inorganic materials particularly with regard to photoconductive performance.

Meanwhile, electrophotographic photosensitive members are required to have durabilities to various external forces of physical, chemical and electrical origins since they are repeatedly affected by charging, exposure, development, transfer, cleaning and charge elimination in electrophotographic processes in copying machines or laser beam printers. In particular, mechanical strength such as wear resistance or scratch resistance is one of important factors for determining the running lifetime of electrophotographic photosensitive members. Since the organic photoconductive materials have no film-forming properties by themselves, it is common for them to be formed into films with use of binders when photosensitive layers are formed. Thus, the properties of binder resins can be a factor that greatly influences the mechanical strength. Accordingly, it has been attempted to make binder resins have a higher molecular weight, to use curable resins and also to use lubricants such as Teflon.

However, the use of high-molecular weight binder resins is problematic in that it causes an increase in viscosity of layer forming coating materials. The use of curable resins may cause a deterioration of organic photoconductive materials when cured, and a deterioration of electrophotographic performance that is ascribable to the presence of unreacted functional groups or impurities such as polymerization initiators. Also, the use of lubricants can not be well satisfactory in view of film forming properties and compatibility.

As image quality and durability have been made much higher in recent years, studies have been made on electrophotographic photosensitive members that can stably provide better images over a long period of time.

SUMMARY OF THE INVENTION

An object of the present invention is to provide an electrophotographic photosensitive member that has a superior durability and can obtain superior images even when repeatedly used.

Another object of the present invention is to provide an electrophotographic apparatus and an apparatus unit which have such an electrophotographic photosensitive member.

The present invention provides an electrophotographic photosensitive member comprising a conductive support and a photosensitive layer provided on the conductive support, wherein a surface layer of said electrophotographic photosensitive member contains a polycarbonate resin having a chain fluoroalkyl group having 4 or more carbon atoms.

The present invention also provides an electrophotographic apparatus and a device unit which have the electrophotographic photosensitive member described above.

DESCRIPTION OF THE PREFERRED EMBODIMENTS

Figure 1:
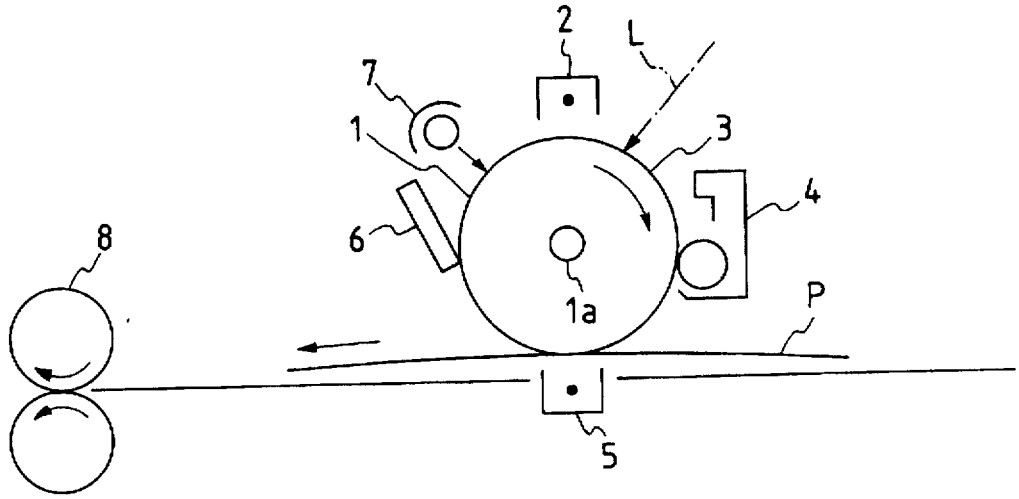
FIG. 1 schematically illustrates an example of the construction of an electrophotographic apparatus having the electrophotographic photosensitive member of the present invention.

The surface layer of the electrophotographic photosensitive member according to the present invention contains a chain fluoroalkyl group having 4 or more carbon atoms.

The polycarbonate resin used in the present invention may preferably be an aromatic polycarbonate resin in view of mechanical strength.

The chain fluoroalkyl group in the present invention has 4 or more carbon atoms, and may more preferably 8 or more carbon atoms. If it has less than 4 carbon atoms, the photosensitive member may have no satisfactory surface lubricity. Such a fluoroalkyl group may be present as the side chain in a monomer unit of the polycarbonate resin, or may be present as a terminal group of the polymer. It may still also be present in both the side chain and the terminal group.

In the case when the chain fluoroalkyl group is present as the side chain in a monomer unit of the polycarbonate resin, the monomer unit may preferably be a unit represented by Formula 1 shown below.

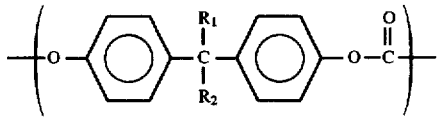

Formula 1 wherein $R_1$ and $R_2$ each represent a hydrogen atom, a substituted or unsubstituted alkyl group, a substituted or unsubstituted aryl group, a substituted or unsubstituted chain fluoroalkyl group, or a group formed by combination of any of these groups, and at least one of $R_1$ and $R_2$ contains a chain fluoroalkyl group having 4 or more carbon atoms.

Preferred examples of $R_1$ and $R_2$ containing the chain fluoroalkyl group are shown below. Examples are by no means limited to these. Letter symbol m in the formula represents an integer of 1 or more, and n represents an integer of 3 or more.

$-(CF_2)_n-CF_3$, $-CH_2-(CF_2)_n-CF_3$, $-CH_2-CH_2-(CF_2)_n-CF_3$, $-[CF_2-CF(CF_3)]_m-CF_2-CF_2-CF_3$, $-CF_2-CF(CF_3)-CF_3$, $-CH_2-[CF_2-CF(CF_3)]_2-CF_2-CF_2-CF_3$, $-C(CF_3)_3$, $-CH_2-CH_2-[CF_2-CF-(CF_3)]_2-CF_2-CF_2-CF_3$,

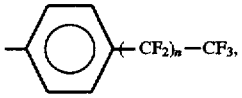

$-(CF_2)_n-CF_3$,

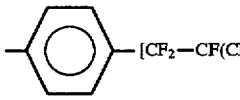

$-[CF_2-CF(CF_3)]_m-CF_2-CF_2-CF_3$,

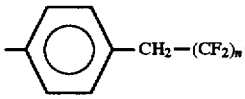

$-CH_2-(CF_2)_n-CF_3$,

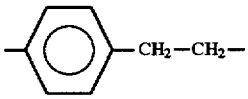

$-CH_2-CH_2-(CF_2)_n-CF_3$,

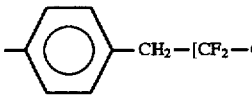

$-CH_2-[CF_2-CF(CF_3)]_2-CF_2-CF_2-CF_3$, and

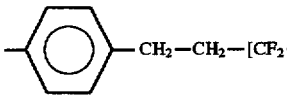

$-CH_2-CH_2-[CF_2-CF(CF_3)]_2-CF_2-CF_2-CF_3$.

Preferred examples of $R_1$ and $R_2$ containing no chain fluoroalkyl group are shown below. Examples are by no means limited to these.

$-H$, $-CH_3$, $-CH_2-CH_3$, $-CH_2-CH_2-CH_3$, $-CH(CH)_3-CH_3$, $-CH_2-CH_2-CH_2-CH_3$, $-CH_2-CH(CH)_3-CH_3$, $-C(CH)_3$, $-CH_2-CH_2-CH_2-CH_2-CH_3$, $-CH_2-CH_2-CH_2-CH_2-CH_2-CH_3$,

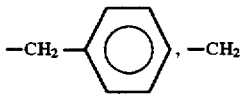

$-CH_2-$, $-CH_2-$ Cl,

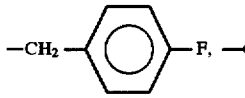

$-CH_2-$ F, $-$ $CF_3$,

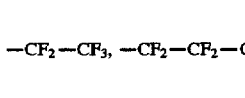

$-CF_2-CF_3$, $-CF_2-CF_2-CF_3$, $-$,

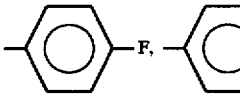

F, $-$ Br,

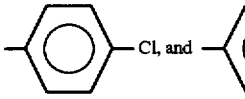

Cl, and $-$ $NO_2$.

Of the monomer unit represented by Formula 1, a particularly preferred one can be a monomer unit represented by the formula:

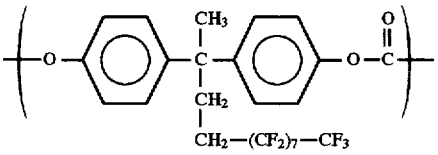

In the case when the chain fluoroalkyl group is present as a terminal group of the polymer of the polycarbonate resin, its monomer unit may preferably be a unit represented by Formula 2 shown below.

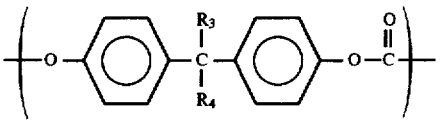

Formula 2 wherein $R_3$ and $R_4$ each represent a hydrogen atom, a substituted or unsubstituted alkyl group, a substituted or unsubstituted aryl group, a substituted or unsubstituted chain fluoroalkyl group, or a cycloalkylidene group formed by combination of $R_3$ and $R_4$.

Preferred examples of the monomer unit represented by Formula 2 may, in addition to those listed in relation to Formula 1, include the following.

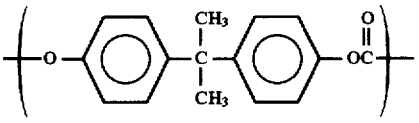

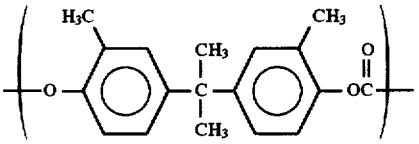

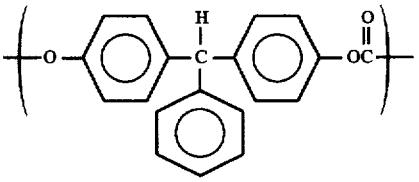

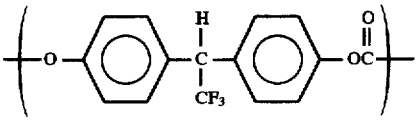

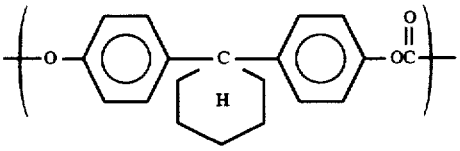

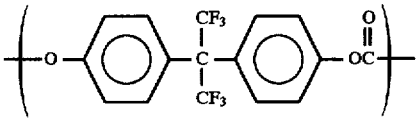

-continued

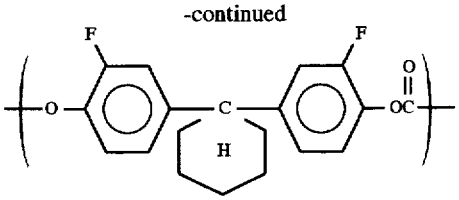

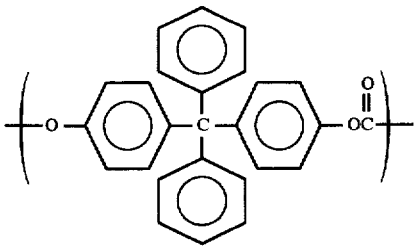

The group at the terminal of the polymer in the present invention may preferably be a group represented by Formula 3 shown below.

Formula 3

$$-Ar-(R)_m-Rf$$

wherein Ar represents a substituted or unsubstituted arylene group; R represents a substituted or unsubstituted alkylene group, an oxygen atom, a sulfur atom, $-S_2$, $$-\overset{O}{\overset{\|}{C}}-,\ -\overset{O}{\overset{\|}{C}}-O-,\ -NH-\overset{O}{\overset{\|}{C}}-$$

or group formed by combination of any of these groups; Rf represents a chain fluoroalkyl group having 4 or more carbon atoms; and m represents 0 or 1.

Preferred examples of Ar are shown below. Examples are by no means limited to these.

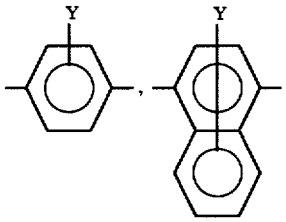

Y is $-CH_3$, —Cl, —Br, —F, —I, —CN $-CF_3$, $-N_2$, —H or the like.

Preferred examples of R are shown below. Examples are by no means limited to these.

$-CH_2-$, $-CH_2CH_2-$, $-OCH_2-$, $-OCH_2CH_2-$, $-COCH_2-$, $-COCH_2CH_2-$, $-COOCH_2-$, $-COOCH_2CH_2-$, $-OCOCH_2-$, $-OCOCH_2CH_2-$, $-CONHCH_2-$, $-CONHCH_2CH_2-$, $-NHCOCH_2-$, $-NHCOCH_2CH_2-$, —O—, —CO—, —COO—, —OCO—, —NHCO—, —S—, and $-SO_2-$.

Preferred examples of Rf are shown below. Examples are by no means limited to these.

$-(-CF_2-)_7-CF_3$, $-(-CF_2-)_9-CF_3$, $-(-CF_2-)_{11}-CF_3$, $-(-CF_2-)_{13}-CF_3$, $-(-CF_2-)_{15}-CF_3$, $-(-CF_2-)_{17}-CF_3$, and $$-(CF_2CF(CF_3))_2-CF_2CF_3.$$

Preferred examples of the terminal group represented by Formula 3 are also shown below. Examples are by no means limited to these.

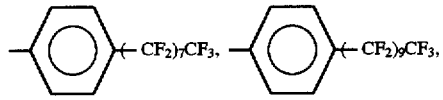

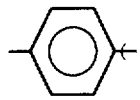

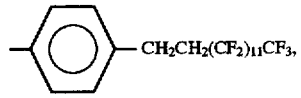

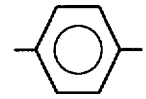

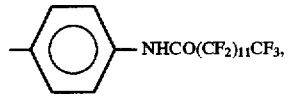

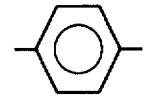

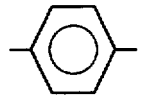

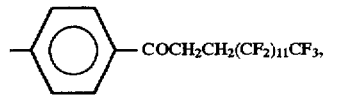

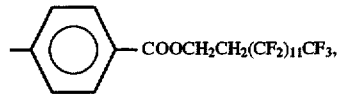

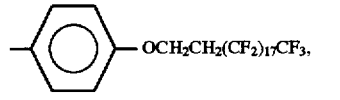

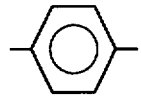

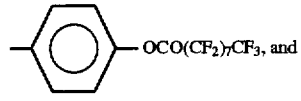

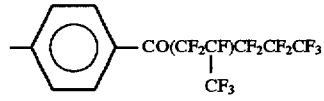

Of the polycarbonate resins of the present invention, having the chain fluoroalkyl group as a terminal group of the polymer, a particularly preferred one can be a resin represented by the formula:

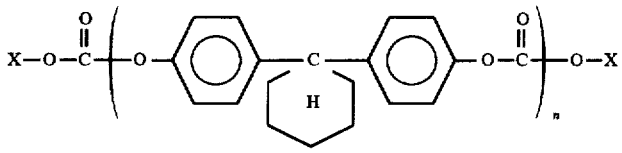

wherein X represents

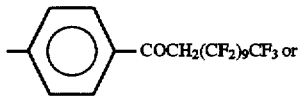

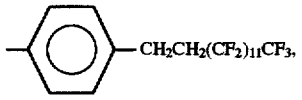

and n represents a degree of polymerization.

The polycarbonate resin used in the present invention may be either a homopolymer or a copolymer, and may preferably have a weight average molecular weight of from 1,000 to 100,000, and particularly preferably from 10,000 to 80,000.

The polycarbonate resin having the chain fluoroalkyl group in the side chain of its monomer unit can be synthesized, for example, in the following way: To a ketone having the groups $R_1$ and $R_2$, $R_1COR_2$, and an excess amount of phenol, a condensing agent strong acid such as hydrochloric acid or sulfuric acid and a catalyst such as ferric chloride, calcium chloride, boric acid or hydrogen sulfide are added to carry out condensation to give a bisphenol having a fluoroalkyl side chain. Next, this bisphenol is mixed in methylene chloride together with sodium hydroxide and an ammonium compound, and the mixture is passed through phosgene.

The polycarbonate resin of the present invention, having the chain fluoroalkyl group at a terminal of the polymer can be synthesized, for example, in the following way.

Bisphenol-Z and the following compound A are mixed in an aqueous sodium hydroxide solution in which dichloromethane and the following compound B have been mixed, and thereafter the mixture is passed through phosgene to obtain compound C which is a polycarbonate resin of the present invention.

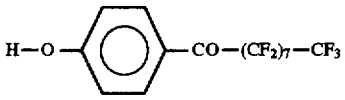

Compound A

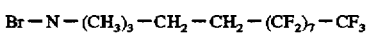

Compound B

Compound C

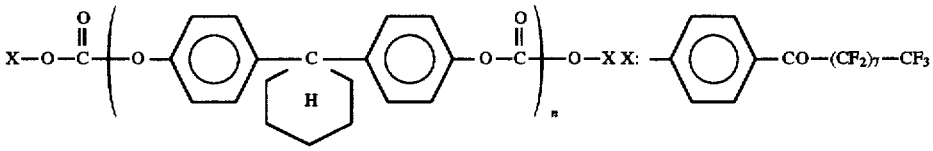

(n represents a degree of polymerization)

The photosensitive layer of the electrophotographic photosensitive member of the present invention may have either a single-layer structure or a multiple-layer structure. The single-layer photosensitive layer contains a charge-generating material and a charge-transporting material, where carriers are produced and transported in the same layer. The multiple-layer photosensitive layer has a charge generation layer containing a charge-generating material in which carriers are produced and a charge transport layer containing a charge-transporting material through which carriers are transported. Either of these layers may be an upper layer, and the charge transport layer may preferably be the upper layer. Whatever structure the layer has, the polycarbonate resin of the present invention is contained in at least a surface layer of the electrophotographic photosensitive member.

The single-layer type photosensitive layer may preferably have a layer thickness of from 5 to 100 μm, and particularly preferably from 10 to 60 μm. The charge-generating material or the charge-transporting material may preferably be contained in an amount of from 20 to 80% by weight, and particularly preferably from 30 to 70% by weight, based on the total weight of the photosensitive layer.

The charge generation layer of the multiple-layer type photosensitive layer may preferably have a layer thickness of from 0.001 to 6 μm, and particularly preferably from 0.01 to 2 μm. The charge-generating material may preferably be contained in an amount of from 10 to 100% by weight, and particularly preferably from 40 to 100% by weight, based on the total weight of the charge generation layer. The charge transport layer may preferably have a layer thickness of from 5 to 100 μm, and particularly preferably from 10 to 60 μm. The charge-transporting material may preferably be contained in an amount of from 20 to 80% by weight, and particularly preferably from 30 to 70% by weight, based on the total weight of the charge transport layer.

The charge-generating material used in the present invention may include phthalocyanine pigments, polycyclic quinone pigments, azo pigments, perylene pigments, indigo pigments, thioindigo pigments, quinacridone pigments, azlenium salt pigments, squarilium dyes, cyanine dyes, pyrylium dyes, thiopyrylium dyes, xanthene coloring metter, qunoneimine coloring matter, triphenylmethane coloring matter, styryl coloring matter, selenium, selenium-tellurium, amorphous silicon and cadmium sulfide. The charge-transporting material used in the present invention may include pyrene compounds, carbazole compounds, hydrazone compounds, N,N-dialkylaniline compounds, diphenylamine compounds, triphenylamine compounds, triphenylmethane compounds, pyrazoline compounds, styryl compounds and stilbene compounds.

These materials are dispersed or dissolved in the polycarbonate resin of the present invention or a different resin when used. Such a different resin may include polyester, polyurethane, polyarylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins and butyral resins. Of these, polycarbonate, polyarylate, polyallyl ether and polystyrene are particularly preferred. It is also preferable to use a reactive epoxy resin or an acrylic or methacrylic monomer or oligomer which is mixed in the above resin and thereafter cured.

In the present invention, the surface layer of the electrophotographic photosensitive member contains the polycarbonate resin of the present invention. For the purpose of, e.g., controlling mechanical strength, the above different resin may be mixed and put into use. In such an instance, the polycarbonate resin of the present invention may be in a content of not less than 0.1% by weight, and particularly preferably not less than 10% by weight based on the total weight of the resins. A layer or layers other than the surface layer may also contain the polycarbonate resin of the present invention, where the above different resin may be used alone or in combination.

In the present invention, the electrophotographic photosensitive member may have a protective layer on its photosensitive layer. In this case, the surface layer is formed of the protective layer, and hence the protective layer at least contains the polycarbonate resin of the present invention. With regard to the different resin, it may be used like that in the photosensitive layer. The protective layer may preferably have a layer thickness of from 0.01 to 20 μm, and particularly preferably from 0.1 to 10 μm.

In the present invention, in order to improve wear resistance, the surface layer may preferably further contain a fluorine atom-containing compound. Such a fluorine atom-containing compound may include polymers or copolymers of tetrafluoroethylene, hexafluoropropylene, trifluoroethylene, chlorotrifluoroethylene, vinylidene fluoride, vinyl fluoride or perfluoroalkyl vinyl ethers, and also inorganic fluorides such as carbon fluoride with a graphite structure substituted with a fluorine atom, and oils substituted with a fluorine atom.

Of these, tetrafluoroethylene, hexafluoropropylene, perfluoroalkyl vinyl ethers and carbon fluoride are particularly preferred. The fluorine atom-containing compound may preferably have a particle diameter of from 0.005 to 2.5 μm, particularly preferably from 0.01 to 0.7 μm, and more preferably from 0.01 to 0.35 μm, as a weight average particle diameter. The fluorine atom-containing compound may also preferably have a molecular weight of from 3,000 to 10,000,000 as a weight average molecular weight. The fluorine atom-containing compound may preferably be in a content of from 5 to 75% by weight based on the total weight of the layer containing the fluorine atom-containing compound.

The polycarbonate resin of the present invention has a fluoroalkyl group, and hence has a superior affinity for the fluorine atom-containing compound, and enables very uniform and stable dispersion of the fluorine atom-containing compound as it is in the state of fine particles. The fluorine atom-containing compound may be dispersed by means of a sand mill, a ball mill, a roll mill, a homogenizer, a nanomizer, a paint shaker, an ultrasonic wave or the like. When dispersed, a fluorine type surface active agent, a graft polymer and a coupling agent may be used as auxiliary agents.

In the present invention, a subbing layer may be provided between the conductive support and the photosensitive layer. The subbing layer is mainly comprised of a resin, and may also contain a conductive material as used in the conductive support described layer, or an acceptor. The resin that can be used may include polyester, polyurethane, polyarylate, polyethylene, polystyrene, polybutadiene, polycarbonate, polyamide, polypropylene, polyimide, polyamidoimide, polysulfone, polyallyl ether, polyacetal, nylon, phenol resins, acrylic resins, silicone resins, epoxy resins, urea resins, allyl resins, alkyd resins and butyral resins.

These layers are each formed on the conductive support by a process such as vacuum deposition or coating. The coating process may include bar coating, knife coating, roll coating, spray coating, dip coating, electrostatic coating and powder coating.

Materials for the conductive support used in the present invention may include metals such as iron, copper, nickel, aluminum, titanium, tin, antimony, indium, lead, zinc, gold and silver, alloys thereof, oxides thereof, carbon, conductive resins, and also resins in which any of these conductive materials have been dispersed. The conductive support have any shape of a cylinder, a sheet or a belt and may preferably have a most suitable shape depending on electrophotographic apparatus used. The conductive materials may often be molded by itself, or may be coated in the form of a coating material or vacuum-deposited.

The electrophotographic photosensitive member of the present invention can be not only used in electrophotographic copying machines, but also widely used in the fields to which electrophotography is applied, e.g., facsimile machines, laser beam printers, CRT printers, LED printers, liquid-crystal printers and laser lithography.

FIG. 1 schematically illustrates the construction of an electrophotographic apparatus in which the electrophotographic photosensitive member of the present invention is used.

In FIG. 1, the numeral 1 denotes a drum photosensitive member serving as an image bearing member, which is rotated around a shaft 1*a* at a given peripheral speed in the direction shown by an arrow. In the course of rotation, the photosensitive member 1 is uniformly charged on its periphery, with positive or negative given potential by the operation of a charging means 2, and then photoimagewise exposed to light L (slit exposure, laser beam scanning exposure, etc.) at an exposure zone 3 by the operation of an imagewise exposure means (not shown). As a result, electrostatic latent images corresponding to the exposed images are successively formed on the periphery of the photosensitive member.

The electrostatic latent images thus formed are subsequently developed by toner by the operation of a developing means 4. The resulting toner-developed images are then successively transferred by the operation of a transfer means 5, to the surface of a transfer medium P fed from a paper feed section (not shown) to the part between the photosensitive member 1 and the transfer means 5 in the manner synchronized with the rotation of the photosensitive member 1.

The transfer medium P on which the images have been transferred is separated from the surface of the photosensitive member and led through an image-fixing means 8, where the images are fixed and then delivered to the outside as a transcript (a copy).

The surface of the photosensitive member 1 after the transfer of images is brought to removal of the toner remaining after the transfer, using a cleaning means 6. Thus the photosensitive member is cleaned on its surface. Further, the charges remaining thereon are eliminated by the operation of a pre-exposure means 7. The photosensitive member is then repeatedly used for the formation of images.

The charging means 2 for giving uniform charge on the photosensitive member 1 include corona chargers, which are commonly put into wide use. As the transfer means 5, corona transfer units are also commonly put into wide use.

In the present invention, the apparatus may be constituted of a combination of plural components joined as one device unit from among the constituents such as the above photosensitive member, developing means and cleaning means so that the unit can be freely mounted on or detached from the body of the apparatus. For example, at least one of the charging means, the developing means and the cleaning means may be held into one device unit together with the photosensitive member so that the unit can be freely mounted or detached using a guide means such as rails provided in the body of the apparatus.

In the case when the electrophotographic apparatus is used as a copying machine or a printer, the photosensitive member is exposed to photoimagewise exposing light L by irradiation with light reflected from, or transmitted through, an original, or is exposed to light by the scanning of a laser beam, the driving of an LED array or the driving of a liquid crystal shutter array according to signals obtained by reading an original with a sensor and converting the information into signals.

Figure 2:
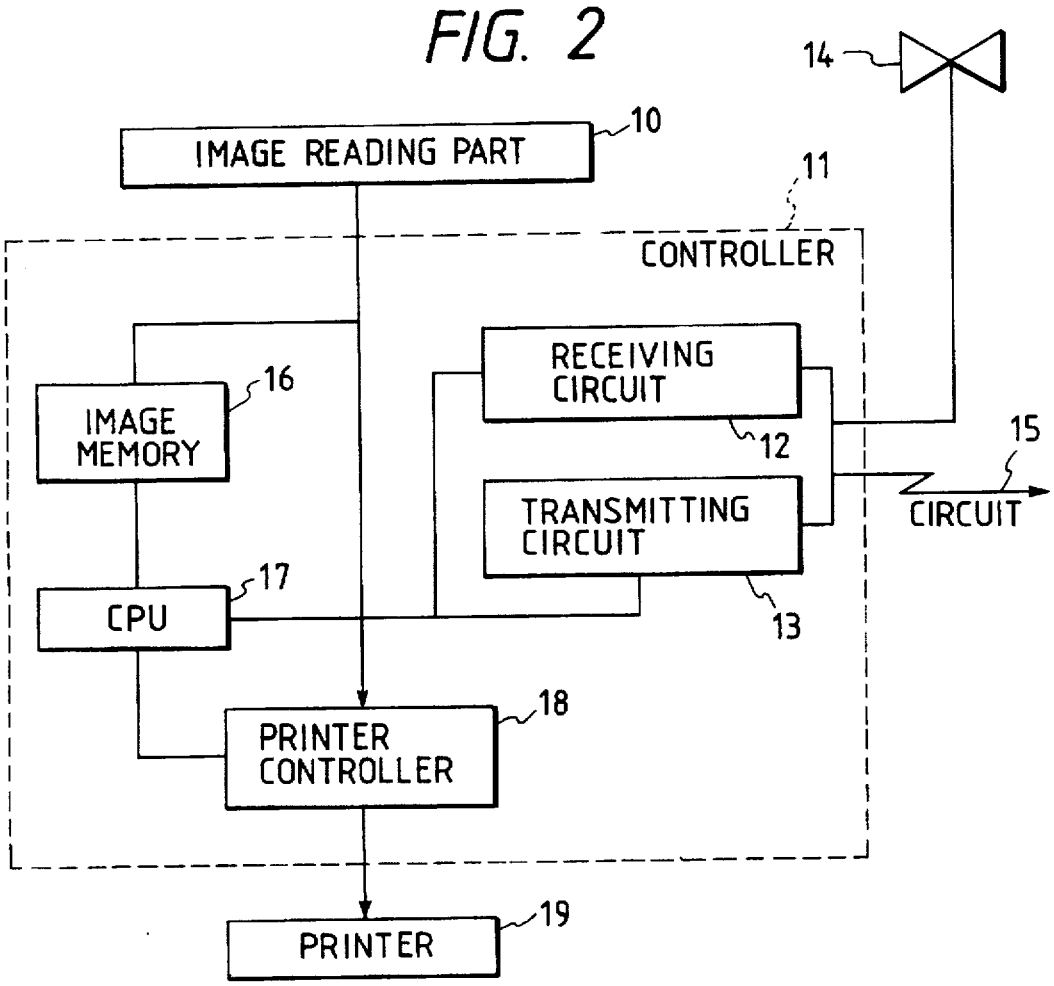
FIG. 2 shows a block diagram of a facsimile system having the electrophotographic photosensitive member of the present invention.

When used as a printer of a facsimile machine, the photoimagewise exposing light L serves as exposing light used for the printing of received data. FIG. 2 illustrates an example thereof in the form of a block diagram.

A controller 11 controls an image reading part 10 and a printer 19. The whole of the controller 11 is controlled by CPU 17. Image data outputted from the image reading part is sent to the other facsimile station through a transmitting circuit 13. Data received from the other station is sent to a printer 19 through a receiving circuit 12. Given image data are stored in an image memory 16. A printer controller 18 controls the printer 19. The numeral 14 denotes a telephone.

An image received from a circuit 15 (image information from a remote terminal connected through the circuit) is demodulated in the receiving circuit 12, and then successively stored in an image memory 16 after the image information is decoded by the CPU 17. Then, when images for at least one page have been stored in the memory 16, the image recording for that page is carried out. The CPU 17 reads out the image information for one page from the memory 16 and sends the coded image information for one page to the printer controller 18. The printer controller 18, having received the image information for one page from the CPU 17, controls the printer 19 so that the image information for one page is recorded.

The CPU 17 receives image information for next page in the course of the recording by the printer 19.

Images are received and recorded in the manner as described above.

EXAMPLES

Example 1

In a solution prepared by dissolving 10 parts (parts by weight, the same applies hereinafter) of a phenol resin precursor (a resol type) in a mixed solvent of 10 parts of methanol and 10 parts of butanol, 5 parts of conductive titanium oxide (weight average particle diameter: 0.4 μm) whose particles had been coated with tin oxide and antimony oxide and 5 parts of high-resistance titanium oxide (weight average particle diameter: 0.4 μm) whose particles had been coated with alumina were dispersed using a sand mill to produce a dispersion. The dispersion was applied to the surface of an aluminum cylinder of 80 mm in outer diameter and 360 mm in length by dip coating, followed by heat-curing to form a conductive layer with a volume resistivity of $5\times10^9$ Ω·cm and a thickness of 20 μm.

Next, a solution prepared by dissolving 3 parts of methoxymethylated nylon (weight average molecular weight: 30,000; degree of methoxymethylation: about 30%) represented by the formula:

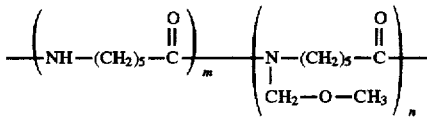

wherein m an n represent a polymerization ratio;

and 9 parts of a 6/66/610/12 quaterpolymer nylon in 150 parts of isopropanol was applied to the surface of the above conductive layer by dip coating, followed by drying to form a subbing layer with a thickness of 1 μm.

Next, in a solution prepared by dissolving 5 parts of a vinyl acetate/vinyl alcohol/vinyl benzal copolymer (weight average molecular weight: 80,000) represented by the formula:

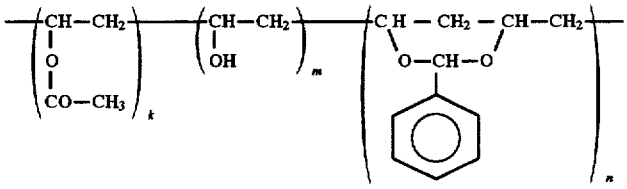

700 parts of cyclohexanone, 10 parts of a disazo pigment represented by the formula:

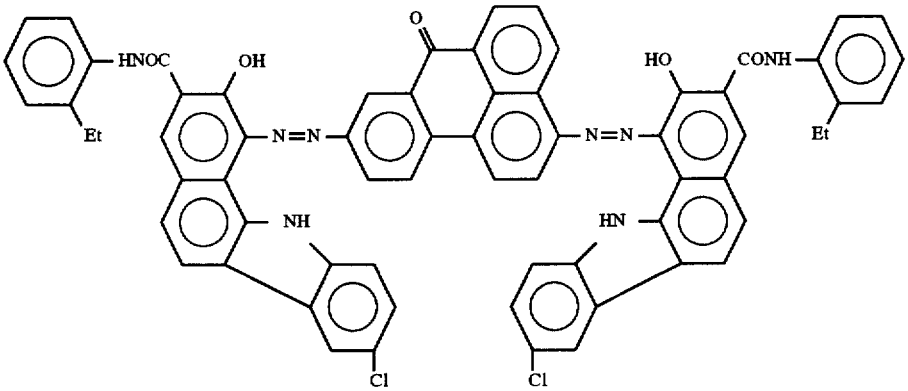

was dispersed using a sand mill to produce a dispersion. The dispersion was applied to the surface of the above subbing layer by dip coating, followed by drying to form a charge generation layer with a thickness of 0.05 μm.

Next, a solution prepared by dispersing and dissolving 10 parts of a triphenylamine represented by the formula:

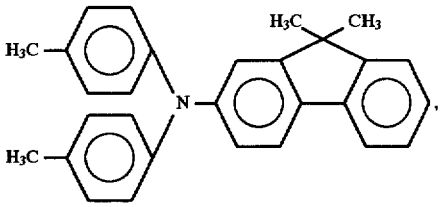

5 parts of a polycarbonate resin (bisphenol-Z type; weight average molecular weight: 25,000) represented by the formula:

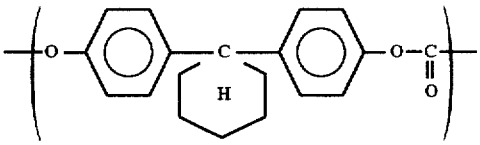

5 parts of a polycarbonate resin (weight average molecular weight: 30,000) represented by the formula:

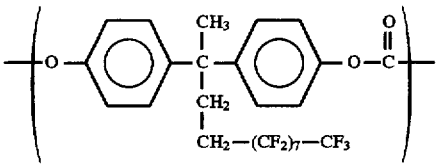

and 3 parts of fine polytetrafluoroethylene powder (an emulsion polymerization product; weight average molecular weight: 35,000; weight average particle diameter: 0.23 μm) in a mixed solvent of 50 parts of monochlorobenzene and 25 parts of dichloromethane using a sand mill was applied to the surface of the above charge generation layer by dip coating, followed by hot-air drying to form a charge transport layer with a thickness of 20 μm. Thus, an electrophotographic photosensitive member was produced.

Comparative Example 1

An electrophotographic photosensitive member was produced in the same manner as in Example 1 except that, in the preparation of the charge transport layer coating material in Example 1, 10 parts of the triphenylamine compound and 10 parts of the bisphenol-Z polycarbonate resin were dissolved in a mixed solvent of 50 parts of monochlorobenzene and 25 parts of dichloromethane to prepare a charge transport layer coating solution.

Evaluation was made on the electrophotographic photosensitive members of Example 1 and Comparative Example 1 in the following manner. Results obtained are shown in Table 1.

Contact angle

Contact angle to pure water, of the surface of the photosensitive member of Example 1 was compared with that of the photosensitive member of Comparative Example 1 by measuring them using a dropping-type contact angle meter (manufactured by Kyowa Kaimen Kagaku K.K.). As a result, the contact angle of the photosensitive member of Example 1 was as large as 109°, showing a low surface energy. On the other hand, the contact angle of the photosensitive member of Comparative Example 1 was as small as 80°, showing no low surface energy.

Practical copying evaluation

The photosensitive members of Example 1 and Comparative Example 1 were each mounted on a copying machine (CLC-500, manufactured by Canon Inc.) to carry out a running test for image reproduction on 20,000 sheets. In the case of the photosensitive member of Comparative Example 1, white-ground image fog seriously occurred on the 13,000th sheet and the machine became unusable. In the case of the photosensitive member of Example 1, on the other hand, good images were obtained even after copying on 20,000 sheets. The wear (depth of wear) of the photosensitive member of Example 1 after the running test was also found to be very smaller than that of the photosensitive member of Comparative Example 1.

Under the same conditions, transfer efficiency and any faulty transfer were also examined after copying on 1,000 sheets. To measure transfer efficiency, a magenta single color halftone image with a reflection density of 0.8 was outputted, where the transfer efficiency was calculated from the ratio of the reflection density of the developer having been transferred to a transfer material to the reflection density of the developer having remained on the photosensitive member. The photosensitive member of Comparative Example 1 showed a transfer efficiency of 75%, and on the other hand the photosensitive member of Example 1 maintained a transfer efficiency of as high as 91%.

With regard to the faulty transfer, evaluation was made on four-color full-color halftone images with a reflection density of 0.6 obtained after copying on 1,000 sheets. The photosensitive member of Comparative Example 1 resulted coarse non-uniform images, but the photosensitive member of Example 1, uniform and high-quality halftone images.

Example 2

To the surface of the photosensitive member of Comparative Example 1, a solution prepared by dispersing and dissolving 30 parts of the triphenylamine compound as used in Example 1, 50 parts of a polycarbonate resin (weight average molecular weight: 20,000) represented by the formula:

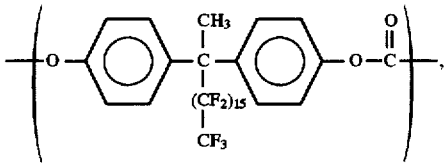

20 parts of the bisphenol-Z polycarbonate resin (weight average molecular weight; 90,000) as used in Example 1 and 30 parts of fine polytetrafluoroethylene powder (an emulsion polymerization product; weight average molecular weight: 35,000; weight average particle diameter: 0.23 μm) in a mixed solvent of 1,050 parts of monochlorobenzene and 425 parts of dichloromethane using a sand mill was applied by spray coating, followed by hot-air drying to form a protective layer with a thickness of 6 μm. Evaluation was made on the resulting electrophotographic photosensitive member in the same manner as in Example 1. Results of the evaluation are shown in Table 1. The surface of this photosensitive member showed a contact angle of as large as 110°. In the evaluation in practical copying, the wear of the photosensitive member after copying on 20,000 sheets was very small, and none of white-ground fog, black lines and so forth occurred. The transfer efficiency after copying on 1,000 sheets was as high as 93%, and also no faulty transfer occurred.

Example 3

To the surface of the photosensitive member of Comparative Example 1, a solution prepared by dispersing and dissolving 30 parts of the triphenylamine compound as used in Example 1, 30 parts of a polycarbonate resin (weight average molecular weight: 25,000) represented by the formula:

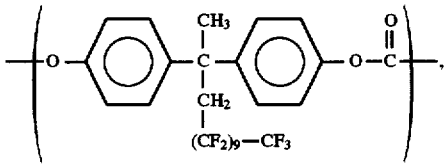

20 parts of the bisphenol-Z polycarbonate resin (weight average molecular weight; 90,000) as used in Example 1 and 35 parts of fine polytetrafluoroethylene powder (an emulsion polymerization product; weight average molecular weight: 35,000; weight average particle diameter: 0.23 μm) in a mixed solvent of 1,050 parts of monochlorobenzene and 425 parts of dichloromethane using a sand mill was applied by spray coating, followed by hot-air drying to form a protective layer with a thickness of 6 μm. Evaluation was made on the resulting electrophotographic photosensitive member in the same mariner as in Example 1. Results of the evaluation are shown in Table 1. The surface of this photosensitive member showed a contact angle of as large as 110°. In the evaluation in practical copying, the wear of the photosensitive member after copying on 20,000 sheets was very small, and none of white-ground fog, black lines and so forth occurred. The transfer efficiency after copying on 1,000 sheets was as high as 94%, and also no faulty transfer occurred.

Example 4

To the surface of the photosensitive member of Comparative Example 1, a solution prepared by dispersing and dissolving 30 parts of the triphenylamine compound as used in Example 1, 30 parts of a polycarbonate resin (weight average molecular weight: 15,000) represented by the formula:

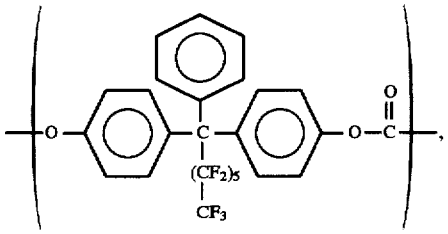

20 parts of the bisphenol-Z polycarbonate resin (weight average molecular weight; 90,000) as used in Example 1 and 40 parts of fine polytetrafluoroethylene powder (an emulsion polymerization product; weight average molecular weight: 35,000; weight average particle diameter: 0.23 μm) in a mixed solvent of 1,050 parts of monochlorobenzene and 425 parts of dichloromethane using a sand mill was applied by spray coating, followed by hot-air drying to form a protective layer with a thickness of 6 μm. Evaluation was made on the resulting electrophotographic photosensitive member in the same manner as in Example 1. Results of the evaluation are shown in Table 1. The surface of this photosensitive member showed a contact angle of as large as 113°. In the evaluation in practical copying, the wear of the photosensitive member after copying on 20,000 sheets was very small, and none of white-ground fog, black lines and so forth occurred. The transfer efficiency after copying on 1,000 sheets was as high as 92%, and also no faulty transfer occurred.

Example 5

To the surface of the photosensitive member of Comparative Example 1, a solution prepared by dispersing and dissolving 30 parts of the triphenylamine compound as used in Example 1, 30 parts of a polycarbonate resin (weight average molecular weight: 20,000) represented by the formula:

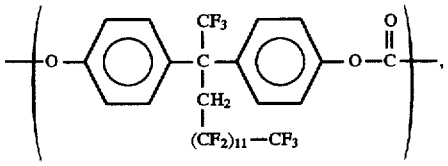

20 parts of the bisphenol-Z polycarbonate resin (weight average molecular weight; 90,000) as used in Example 1 and 40 parts of fine tetrafluoroethylene/hexafluoropropylene copolymer powder (an emulsion polymerization product; weight average molecular weight: 35,000; weight average particle diameter: 0.23 μm) in a mixed solvent of 1,050 parts of monochlorobenzene and 425 parts of dichloromethane using a sand mill was applied by spray coating, followed by hot-air drying to form a protective layer with a thickness of 6 μm. Evaluation was made on the resulting electrophotographic photosensitive member in the same manner as in Example 1. Results of the evaluation are shown in Table 1. The surface of this photosensitive member showed a contact angle of as large as 112°. In the evaluation in practical copying, the wear of the photosensitive member after copying on 20,000 sheets was very small, and none of white-ground fog, black lines and so forth occurred. The transfer efficiency after copying on 1,000 sheets was as high as 93%, and also no faulty transfer occurred.

TABLE 1

| | | Practical copying evaluation | | | | |
|---|---|---|---|---|---|---|
| | Contact angle (°) | Wear (μm*) | White ground fog | Black lines | Transfer efficiency (%) | Uneven transfer |
| Example: | | | | | | |
| 1 | 109 | 6.3 | A | A | 91 | A |
| 2 | 110 | 2.7 | A | A | 93 | A |
| 3 | 110 | 2.5 | A | A | 94 | A |
| 4 | 113 | 2.3 | A | A | 92 | A |
| 5 | 121 | 2.2 | A | A | 93 | A |
| Comparative Example: | | | | | | |
| 1 | 80 | 8.9 | C | C | 75 | C |

*per 10,000 sheets
A: Good (None);
C: Unpassable (Occurred)

Example 6

A solution prepared by dissolving 10 parts of the methoxymethylated nylon as used in Example 1 in 150 parts of isopropanol was applied to the surface of an aluminum cylinder of 80 mm in outer diameter and 360 mm in length by dip coating, followed by drying to form a subbing layer with a thickness of 1 μm.

Next, in a solution prepared by dissolving 5 parts of a polycarbonate resin (bisphenol-A type; weight average molecular weight: 30,000) in 700 parts of cyclohexanone, 10 parts of the disazo pigment as used in Example 1 was dispersed using a sand mill to produce a dispersion. The dispersion was applied to the surface of the above subbing layer by dip coating, followed by drying to form a charge generation layer with a thickness of 0.05 μm.

Next, a solution prepared by mixing and dissolving 10 parts of a triphenylamine represented by the formula:

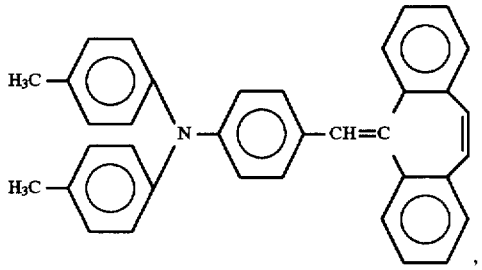

7 parts of a polycarbonate resin (weight average molecular weight: 20,000) represented by the formula:

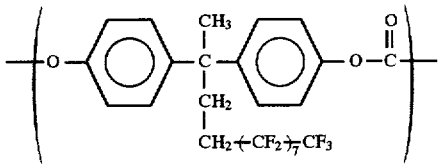

and 3 parts of a polycarbonate resin (bisphenol-Z type; weight average molecular weight: 25,000) represented by the formula:

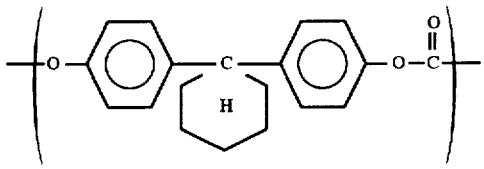

in a mixed solvent of 150 parts of monochlorobenzene and 100 parts of dichloromethane was applied to the surface of the above charge generation layer by dip coating, followed by drying to form a charge transport layer with a thickness of 20 μm. Thus, an electrophotographic photosensitive member was produced.

Another electrophotographic photosensitive member was produced in the same manner as the above except that the aluminum cylinder was replaced with a 50 μm thick aluminum sheet.

Comparative Example 2

Comparative electrophotographic photosensitive members were produced in the same manner as in Example 6 except that only the bisphenol-Z polycarbonate resin was used as a binder resin for the charge transport layer.

Evaluation was made on the electrophotographic photosensitive members of Example 6 and Comparative Example 2 in the following manner.

Abrasion resistance test

Using a Taber's abrasion resistance tester, the photosensitive members making use of the aluminum sheet were tested for abrasion resistance under a load of 500 g (two truck wheels) and at 5,000 cycles. The decrease in weight that resulted from abrasion, of the photosensitive member of Example 6 was smaller by about 25% than that of the photosensitive member of Comparative Example 2. Thus, the specific polycarbonate resin used in the present invention was found to be effective.

Contact angle

Contact angles to water, of the photosensitive members making use of the aluminum sheet were compared by measuring them using a dropping-type contact angle meter. As a result, the contact angle of the photosensitive member of Example 6 was as large as 109°. On the other hand, that of the photosensitive member of Comparative Example 2 was as small as 81°.

Practical copying evaluation

The photosensitive members of Example 6 and Comparative Example 2 were each mounted on a copying machine (CLC-500, manufactured by Canon Inc.) to carry out a running test for image reproduction on 20,000 sheets. In the case of the photosensitive member of Comparative Example 2, white-ground image fog seriously occurred on the 13,000th sheet and the machine became unusable. In the case of the photosensitive member of Example 6, on the other hand, good images were obtained even after copying on 20,000 sheets. The wear (depth of wear) of the photosensitive member of Example 6 after the running test was also found to be smaller by about 25% than that of the photosensitive member of Comparative Example 2. Results obtained are shown in Table 2.

Example 7

To the surface of the photosensitive member of Comparative Example 2, a solution prepared by mixing and dissolving 30 parts of the triphenylamine compound as used in Example 6, 50 parts of a polycarbonate resin (weight average molecular weight: 15,000) represented by the formula:

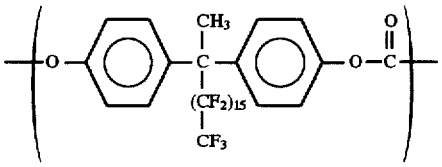

and 20 parts of a polycarbonate resin (bisphenol-Z type; weight average molecular weight; 70,000) represented by the formula:

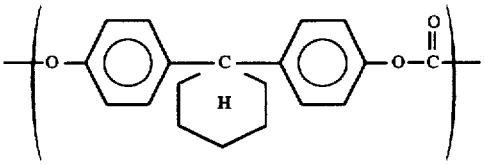

in a mixed solvent of 1,000 parts of monochlorobenzene and 500 parts of dichloromethane was applied by spray coating, followed by hot-air drying to form a protective layer with a thickness of 6 μm. Evaluation was made on the resulting electrophotographic photosensitive member in the same manner as in Example 6. Results obtained are shown in Table 2. This photosensitive member has a superior abrasion resistance and a superior releasability.

Example 8

To the surface of the photosensitive member of Comparative Example 2, a solution prepared by mixing and dissolving 30 parts of the triphenylamine compound as used in Example 6, 30 parts of a polycarbonate resin (weight average molecular weight: 10,000) represented by the formula:

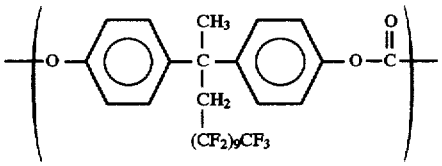

and 30 parts of a polycarbonate resin (bisphenol-Z type; weight average molecular weight; 70,000) represented by the formula:

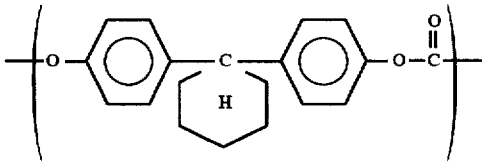

in a mixed solvent of 1,000 parts of monochlorobenzene and 500 parts of dichloromethane was applied by spray coating, followed by hot-air drying to form a protective layer with a thickness of 6 μm. Evaluation was made on the resulting electrophotographic photosensitive member in the same manner as in Example 6. Results obtained are shown in Table 2. This photosensitive member has a superior abrasion resistance and a superior releasability.

Example 9

To the surface of the photosensitive member of Comparative Example 2, a solution prepared by mixing and dissolving 30 parts of the triphenylamine compound as used in Example 6, 30 parts of a polycarbonate resin (weight average molecular weight: 25,000) represented by the formula:

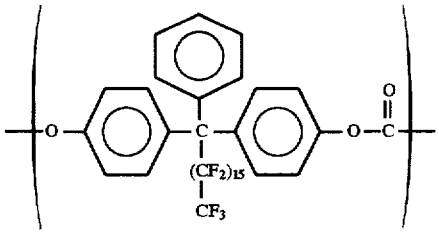

and 20 parts of a polycarbonate resin (bisphenol-Z type; weight average molecular weight: 70,000) represented by the formula:

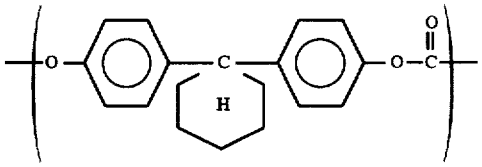

in a mixed solvent of 1,000 parts of monochlorobenzene and 500 parts of dichloromethane was applied by spray coating, followed by hot-air drying to form a protective layer with a thickness of 6 μm. Evaluation was made on the resulting electrophotographic photosensitive member in the same manner as in Example 6. Results obtained are shown in Table 2. This photosensitive member has a superior abrasion resistance and a superior releasability.

Example 10

To the surface of the photosensitive member of Comparative Example 2, a solution prepared by mixing and dissolving 30 parts of the triphenylamine compound as used in Example 6, 30 parts of a polycarbonate resin (weight average molecular weight: 20,000) represented by the formula:

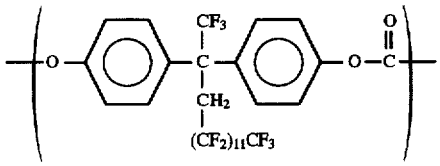

and 20 parts of a polycarbonate resin (bisphenol-Z type; weight average molecular weight: 70,000) represented by the formula:

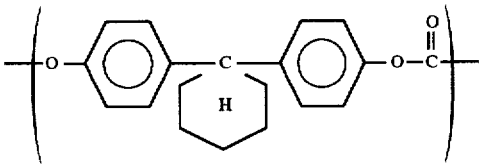

in a mixed solvent of 1,000 parts of monochlorobenzene and 500 parts of dichloromethane was applied by spray coating, followed by hot-air drying to form a protective layer with a thickness of 6 μm. Evaluation was made on the resulting electrophotographic photosensitive member in the same manner as in Example 6. Results obtained are shown in Table 2. This photosensitive member has a superior abrasion resistance and a superior releasability.

TABLE 2

| | Taber's abration (mg) | Contact angle (°) | Practical copying evaluation Wear (μm*) | White-ground image fog |
|---|---|---|---|---|
| Example: | | | | |
| 6 | 6.4 | 109 | 6.8 | No fog |
| 7 | 6.7 | 109 | 6.8 | No fog |
| 8 | 5.9 | 110 | 6.5 | No fog |
| 9 | 6.4 | 111 | 6.2 | No fog |
| 10 | 6.3 | 113 | 6.1 | No fog |
| Comparative Example 2 | 8.6 | 81 | 8.4 | Fog occurred |

*per 10,000 sheets

Example 11

A subbing layer and a charge generation layer were formed on an aluminum cylinder in the same manner as in Example 6.

Next, a solution prepared by dispersing and dissolving 10 parts of a triphenylamine represented by the formula:

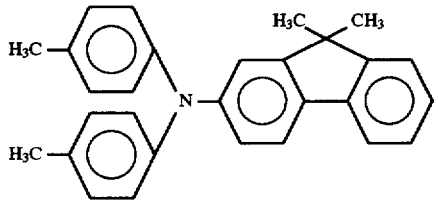

3 parts of fine polytetrafluoroethylene resin powder (weight average particle diameter: 0.33 μm; weight average molecular weight: about 300,000), 7 parts of a polycarbonate resin (weight average molecular weight: 20,000) represented by the formula:

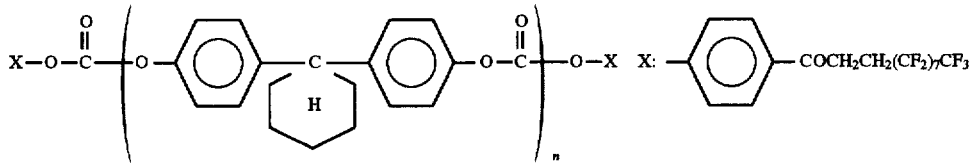

(n represents a degree of polymerization)

and 3 parts of a polycarbonate resin (bisphenol-Z type; weight average molecular weight: 25,000) represented by the formula:

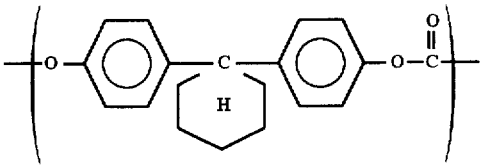

in a mixed solvent of 150 parts of monochlorobenzene and 100 parts of dichloromethane using a sand mill was applied to the surface of the above charge generation layer by dip coating, followed by hot-air drying to form a charge transport layer with a thickness of 20 μm. Thus, an electrophotographic photosensitive member was produced.

Another electrophotographic photosensitive member was produced in the same manner as the above except that the aluminum cylinder was replaced with a 50 μm thick aluminum sheet.

Comparative Example 3

To the surface of the charge generation layer as formed in Example 11, a solution prepared by mixing and dissolving 10 parts of the triphenylamine compound as used in Example 11 and 10 parts of a polycarbonate resin (weight average molecular weight: 25,000) represented by the formula:

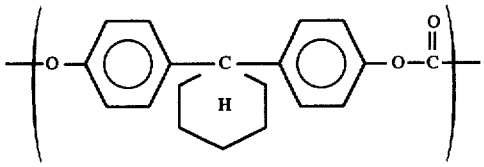

in a mixed solvent of 150 parts of monochlorobenzene and 100 parts of dichloromethane was applied by dip coating, followed by hot-air drying to form a charge transport layer with a thickness of 20 μm. Thus, an electrophotographic photosensitive member was produced. Similarly, another electrophotographic photosensitive member was produced using a 50 μm thick aluminum sheet.

Evaluation was made on the electrophotographic photosensitive members of Example 11 and Comparative Example 3 in the following manner.

Abrasion resistance test

Using a Taber's abrasion resistance tester, the photosensitive members making use of the aluminum sheet were tested for abrasion resistance under a load of 500 g (two truck wheels) and at 5,000 cycles. The decrease in weight that resulted from abrasion, of the photosensitive member of Example 11 was smaller by about 30% than that of the photosensitive member of Comparative Example 3. Thus, the use of the polycarbonate resin of the present invention was found to be effective.

Contact angle

Contact angles to water, of the photosensitive members making use of the aluminum sheet were compared by measuring them using a dropping-type contact angle meter. As a result, the contact angle of the photosensitive member of Example 11 was as large as 109°. On the other hand, that of the photosensitive member of Comparative Example 3 was as small as 80°.

Transfer efficiency

The photosensitive members were each mounted on a copying machine (NP-4835, manufactured by Canon Inc.) to examine transfer efficiency at the initial stage. The photosensitive member of Example 11 showed a transfer efficiency of 93%. On the other hand, the photosensitive member of Comparative Example 3 showed a transfer efficiency of as low as 86%.

Practical copying evaluation

The photosensitive members were each mounted on a copying machine (NP-4835, manufactured by Canon Inc.) to carry out a running test for image reproduction on 20,000 sheets. In the case of the photosensitive member of Comparative Example 3, a decrease in image density seriously occurred on the 12,000th sheet and the machine became unusable. In the case of the photosensitive member of Example 11, on the other hand, good images were obtained even after copying on 20,000 sheets. The wear (depth of wear) of the photosensitive member of Example 11 after the running test was also found to be smaller by about 35% than that of the photosensitive member of Comparative Example 3, showing an improvement in running performance.

Example 12

To the surface of the photosensitive member of Comparative Example 3, a solution prepared by dispersing and dissolving 30 parts of the triphenylamine compound as used in Example 11, 20 parts of the polycarbonate resin of the present invention as used in Example 11, 20 parts of a polycarbonate resin (bisphenol-Z type; weight average molecular weight: 70,000) and 30 parts of the fine polytetrafluoroethylene powder as used in Example 11, in a mixed solvent of 1,000 parts of monochlorobenzene and 500 parts of dichloromethane in the same manner as in Example 2 was applied by spray coating, followed by hot-air drying to form a protective layer with a thickness of 6 μm. Evaluation was made on the resulting electrophotographic photosensitive member in the same manner as in Example 11. As a result, the abrasion and the wear after the Taber's abrasion resistance test and the practical copying machine test decreased by 70% and 75%, respectively, compared with those of Comparative Example 3, showing a superior abrasion resistance. The contact angle was as large as 113°, showing a superior releasability.

Example 13

To the surface of the photosensitive member of Comparative Example 3, a solution prepared by dispersing and dissolving 20 parts of the triphenylamine compound as used in Example 11, 20 parts of a polycarbonate resin (weight average molecular weight: 15,000) represented by the formula:

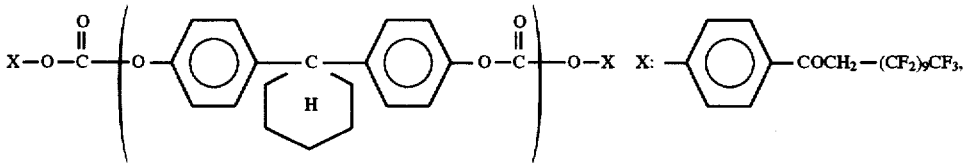

20 parts of the polycarbonate resin (bisphenol-Z type; weight average molecular weight; 80,000) represented by the formula:

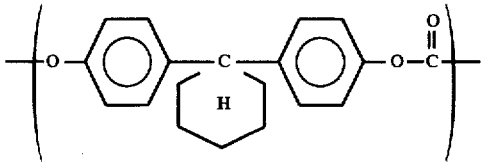

and 40 parts of fine polytetrafluoroethylene powder as used in Example 11, in a mixed solvent of 1,000 parts of monochlorobenzene and 500 parts of dichloromethane was applied by spray coating, followed by hot-air drying to form a protective layer with a thickness of 6 μm. Evaluation was made on the resulting electrophotographic photosensitive member in the same manner as in Example 11. As a result, the abrasion and the wear after the Taber's abrasion resistance test and the practical copying machine test decreased by 80% and 80%, respectively, compared with those of Comparative Example 3, showing a superior abrasion resistance. The contact angle was as large as 115°, showing a superior releasability.

Example 14

To the surface of the photosensitive member of Comparative Example 3, a solution prepared by dispersing and dissolving 20 parts of the triphenylamine compound as used in Example 11, 20 parts of a polycarbonate resin (weight average molecular weight: 25,000) represented by the formula:

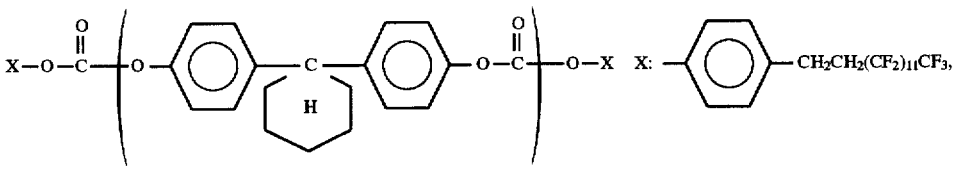

25 parts of a polycarbonate resin (bisphenol-Z type; weight average molecular weight; 80,000) represented by the formula:

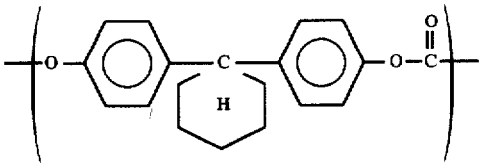

and 40 parts of the fine polytetrafluoroethylene powder as used in Example 11, in a mixed solvent of 1,000 parts of monochlorobenzene and 500 parts of dichloromethane was applied by spray coating, followed by hot-air drying to form a protective layer with a thickness of 6 μm. Evaluation was made on the resulting electrophotographic photosensitive member in the same manner as in Example 11. As a result, the abrasion and the wear after the Taber's abrasion resistance test and the practical copying machine test decreased by 75% and 80%, respectively, compared with those of Comparative Example 3, showing a superior abrasion resistance. The contact angle was as large as 114°, showing a superior releasability.

Example 15

To the surface of the photosensitive member of Comparative Example 3, a solution prepared by dispersing and dissolving 20 parts of the triphenylamine compound as used in Example 11, 10 parts of a polycarbonate resin (weight average molecular weight: 10,000) represented by the formula:

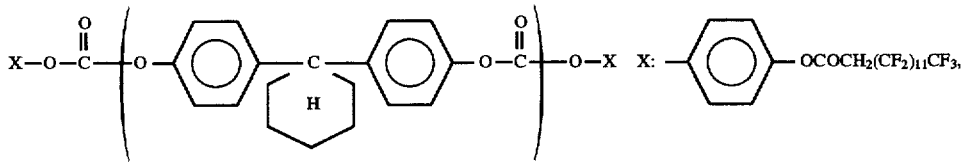

30 parts of a polycarbonate resin (bisphenol-Z type; weight average molecular weight; 80,000) represented by the formula:

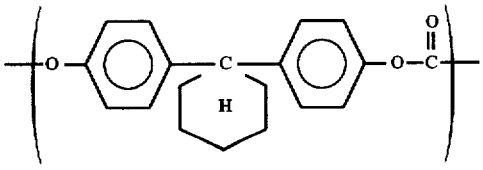

and 40 parts of the fine polytetrafluoroethylene powder as used in Example 11, in a mixed solvent of 1,000 parts of monochlorobgnzene and 500 parts of dichloromethane was applied by spray coating, followed by hot-air drying to form a protective layer with a thickness of 6 μm. Evaluation was made on the resulting electrophotographic photosensitive member in the same manner as in Example 11. As a result, the abrasion and the wear after the Taber's abrasion resistance test and the practical copying machine test decreased by 80% and 80%, respectively, compared with those of Comparative Example 3, showing a superior abrasion resistance. The contact angle was as large as 116°, showing a superior releasability.

Example 16

To the surface of the photosensitive member of Comparative Example 3, a solution prepared by dispersing and dissolving 20 parts of the triphenylamine compound as used in Example 11, 10 parts of a polycarbonate resin (weight average molecular weight: 15,000) represented by the formula:

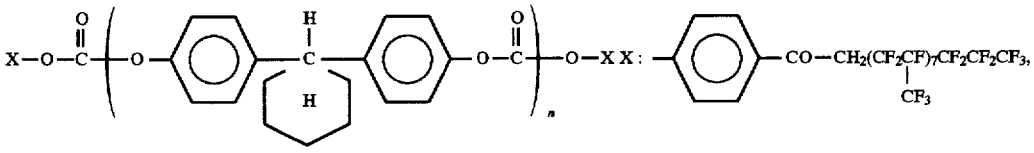

30 parts of a polycarbonate resin (bisphenol-Z type; weight average molecular weight; 80,000) represented by the formula:

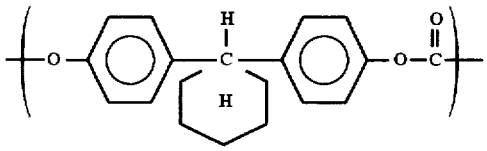

and 40 parts of fine polytetrafluoroethylene powder as used in Example 11, in a mixed solvent of 1,000 parts of monochlorobenzene and 500 parts of dichloromethane was applied by spray coating, followed by hot-air drying to form a protective layer with a thickness of 6 μm. Evaluation was made on the resulting electrophotographic photosensitive member in the same manner as in Example 11. As a result, the abrasion and the wear after the Taber's abrasion resistance test and the practical copying machine test decreased by 80% and 80%, respectively, compared with those of Comparative Example 3, showing a superior abrasion resistance. The contact angle was as large as 116°, showing a superior releasability.

Comparative Example 4

It was attempted to disperse and dissolve 40 parts of the triphenylamine compound as used in Example 11, 30 parts of a polycarbonate resin (bisphenol-Z type; weight average molecular weight; 80,000) represented by the formula:

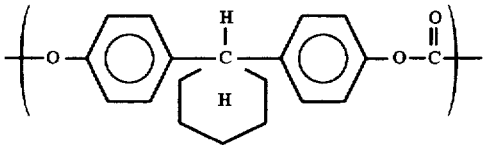

and 80 parts of the fine polytetrafluoroethylene powder as used in Example 11, in a mixed solvent of 1,000 parts of monochlorobenzene and 500 parts of dichloromethane. However, tetrafluoroethylene did not disperse to its primary particle diameter, and no coating material feasible for coating was obtainable.

Results of the evaluation on the electrophotographic photosensitive members of Examples 11 to 16 and Comparative Examples 3 and 4 are shown in Table 3.

TABLE 3

| | | | Practical copying evaluation | | |
|---|---|---|---|---|---|
| | Taber's abrasion (mg) | Contact angle (°) | Transfer efficiency (%) | Wear (μm*) | Image density decrease |
| Example: | | | | | |
| 11 | 6.1 | 109 | 93 | 2.5 | None |
| 12 | 2.7 | 113 | 95 | 1.1 | None |
| 13 | 1.8 | 115 | 96 | 0.9 | None |
| 14 | 2.3 | 114 | 95 | 0.8 | None |
| 15 | 1.8 | 113 | 95 | 0.8 | None |
| 16 | 1.8 | 81 | 95 | 0.7 | None |

TABLE 3-continued

| | | | Practical copying evaluation | | |
|---|---|---|---|---|---|
| | Taber's abrasion (mg) | Contact angle (°) | Transfer efficiency (%) | Wear (μm*) | Image density decrease |
| Comparative Example | | | | | |
| 3 | 8.6 | 80 | 86 | 3.8 | Occurred |
| 4 | — | — | — | — | — |

*per 10,000 sheets

Comparative Example 4: Impossible to produce a photosensitive member.

Comparative Examples 5 to 8

Electrophotographic photosensitive members were produced in the same manner as in Example 1 except that the polycarbonate resin of the present invention was respectively replaced with polycarbonate resins of the formulas:

(Comparative Example 5)

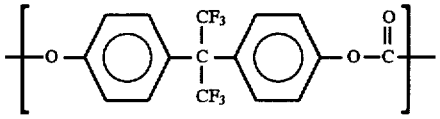

(Comparative Example 6)

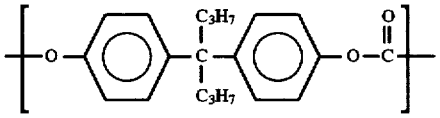

(Comparative Example 7)

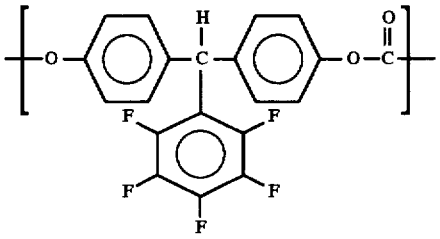

(Comparative Example 8)

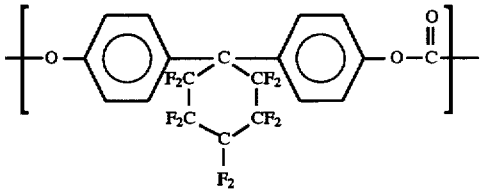

Evaluation was made similarly.

Results obtained are shown in Table 4.

TABLE 4

| | Practical copying evaluation | | | | | |
|---|---|---|---|---|---|---|
| | Contact angle (°) | Wear (μm*) | White ground fog | Black lines | Transfer efficiency (%) | Uneven transfer |
| Comparative Example: | | | | | | |
| 5 | 90 | 8.2 | C | C | 81 | C |
| 6 | 83 | 8.3 | C | C | 80 | C |
| 7 | 87 | 8.0 | C | C | 82 | C |
| 8 | 90 | 8.0 | C | C | 80 | C |

*per 10,000 sheets
C: Unpassable

What is claimed is:

1. An electrophotographic photosensitive member comprising a conductive support and a photosensitive layer provided on the conductive support, wherein a surface layer of said electrophotographic photosensitive member contains a polycarbonate resin which comprises a monomer unit represented by Formula 1:

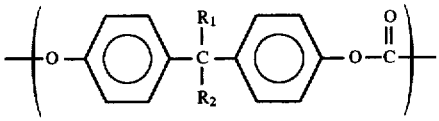

Formula 1 wherein $R_1$ and $R_2$ are each a hydrogen atom, a substituted or unsubstituted alkyl group, a substituted or unsubstituted aryl group, a substituted or unsubstituted chain fluoroalkyl group, or a group formed by combination of any of these groups, and at least one of $R_1$ and $R_2$ is a chain perfluoroalkyl group having 4 or more carbon atoms, methyl or ethyl having a nerfluoroalkyl group having 4 or more carbon atoms or a phenyl group having a perfluoroalkyl group having 4 or more carbon atoms.

2. An electrophotographic photosensitive member according to claim 1, wherein said chain perfluoroalkyl group has 8 or more carbon atoms.

3. An electrophotographic photosensitive member according to claim 1, wherein said surface layer further contains a fluorine atom-containing compound particle.

4. An electrophotographic photosensitive member according to claim 3, wherein said fluorine atom-containing compound particle is selected from the group consisting of tetrafluoroethylene, hexafluoropropylene, a perfluroalkyl vinyl ether and carbon fluoride.

5. An electrophotographic photosensitive member according to claim 1, wherein said surface layer is a photosensitive layer.

6. An electrophotographic photosensitive member according to claim 5, wherein said surface layer is a charge transport layer.

7. An electrophotographic photosensitive member according to claim 1, wherein said surface layer is a protective layer.

* * * * *

UNITED STATES PATENT AND TRADEMARK OFFICE

CERTIFICATE OF CORRECTION

PATENT NO. : 5,800,955

DATED : SEPTEMBER 1, 1998

INVENTOR(S) :

NOBURU KASHIMURA ET AL.

It is certified that error appears in the above-identified patent and that said Letters Patent is hereby corrected as shown below:

COLUMN 1

Line 47, "have" should read --having--; and
Line 58, "can not" should read --cannot--.

COLUMN 5

Line 28, "—$S_2$," should read ---—$SO_2$—,--; and
Line 34, "or" should read --or a--.

COLUMN 8

Line 48, "metter," should read --matter,--.

COLUMN 10

Line 26, "have" should read --may have--.

COLUMN 12

Line 40, "an" should read --and--.

COLUMN 15

Line 2, "resulted" should read --resulted in--; and
Line 67, "mariner" should read --manner--.

UNITED STATES PATENT AND TRADEMARK OFFICE

CERTIFICATE OF CORRECTION

PATENT NO. : 5,800,955

DATED : SEPTEMBER 1, 1998

INVENTOR(S) :

NOBURU KASHIMURA ET AL.

It is certified that error appears in the above-identified patent and that said Letters Patent is hereby corrected as shown below:

COLUMN 26

Line 21, "monochlorobgnzene" should read --monochlorobenzene--;

Lines 55-65, " 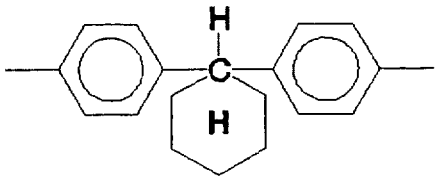 " should read

-- 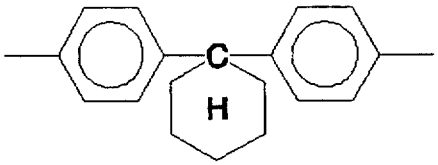 --.

UNITED STATES PATENT AND TRADEMARK OFFICE

CERTIFICATE OF CORRECTION

PATENT NO. :5,800,955

DATED : SEPTEMBER 1, 1998

INVENTOR(S) :

NOBURU KASHIMURA ET AL.

It is certified that error appears in the above-identified patent and that said Letters Patent is hereby corrected as shown below:

COLUMN 27

Lines 5-10, " 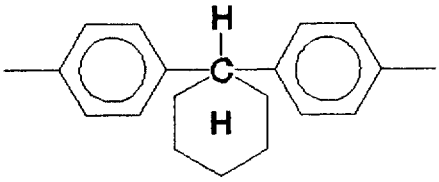 " should read

-- 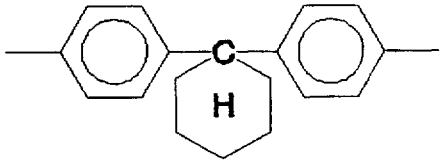 --.

Lines 35-40, " 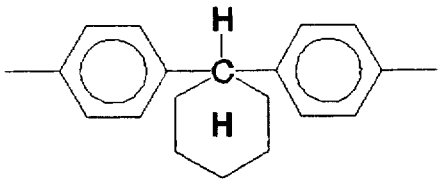 " should read

-- 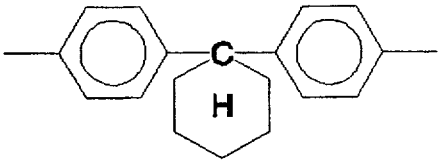 --.

UNITED STATES PATENT AND TRADEMARK OFFICE

CERTIFICATE OF CORRECTION

PATENT NO. : 5,800,955

DATED : SEPTEMBER 1, 1998

INVENTOR(S) :

NOBURU KASHIMURA ET AL.

It is certified that error appears in the above-identified patent and that said Letters Patent is hereby corrected as shown below:

COLUMN 28

Lines 40-45, " 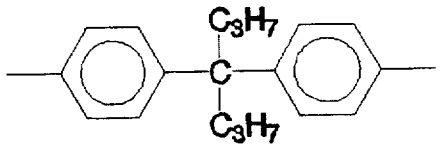 " should read

-- 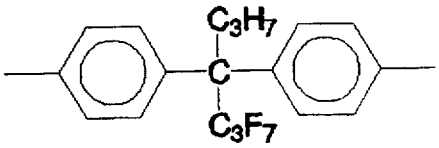 --.

UNITED STATES PATENT AND TRADEMARK OFFICE

CERTIFICATE OF CORRECTION

PATENT NO. : 5,800,955

DATED : SEPTEMBER 1, 1998

INVENTOR(S) :

NOBURU KASHIMURA ET AL.

It is certified that error appears in the above-identified patent and that said Letters Patent is hereby corrected as shown below:

COLUMN 30

Line 7, "nerfluoroalkyl" should read --perfluoroalkyl--;
Line 19, "perfluroalkyl" should read --perfluoroalkyl--.

Signed and Sealed this

Seventeenth Day of August, 1999

*Attest:*

Q. TODD DICKINSON

*Attesting Officer*

*Acting Commissioner of Patents and Trademarks*